US012678853B2

(12) United States Patent
Bergmann et al.

(10) Patent No.: US 12,678,853 B2
(45) Date of Patent: Jul. 14, 2026

(54) METHOD FOR MANUFACTURING A DISTRIBUTOR FOR REFRIGERANT IN A THERMAL MANAGEMENT MODULE

(71) Applicant: MAHLE INTERNATIONAL GMBH, Stuttgart (DE)

(72) Inventors: Ralf Bergmann, Leutenbach (DE); Michael Boeltz, Michelfeld (DE); Thomas Buehler, Wellendingen (DE); Wolfgang Janisch, Stuttgart (DE); Anja Kies, Weil der Stadt (DE); Harald Müller, Stuttgart (DE); Michael Schmidt, Bietigheim-Bissingen (DE)

(73) Assignee: MAHLE International GmbH, Stuttgart (DE)

( * ) Notice: Subject to any disclaimer, the term of this patent is extended or adjusted under 35 U.S.C. 154(b) by 91 days.

(21) Appl. No.: 18/670,999

(22) Filed: May 22, 2024

(65) Prior Publication Data

US 2024/0399820 A1 Dec. 5, 2024

(30) Foreign Application Priority Data

May 30, 2023 (DE) ..... 102023205049.8

(51) Int. Cl.
*B23P 15/26* (2006.01)
*B22C 9/10* (2006.01)
(Continued)

(52) U.S. Cl.
CPC ..... *B22C 9/105* (2013.01); *B22C 9/10* (2013.01); *B22C 9/24* (2013.01); *F25B 41/42* (2021.01); *F28F 2255/14* (2013.01)

(58) Field of Classification Search
CPC ... B22C 9/105; B22C 9/10; B22C 9/24; F25B 41/42; F28F 2255/14; B60H 1/00571
See application file for complete search history.

(56) References Cited

U.S. PATENT DOCUMENTS

2024/0317016 A1* 9/2024 Martin ..... B60H 1/00278
2025/0269424 A1* 8/2025 Schnubel ..... B22C 9/064

FOREIGN PATENT DOCUMENTS

CN 220108530 U * 11/2023 ..... B60H 1/00485
DE 102010002999 A1 * 9/2011 ..... B22C 9/105
(Continued)

OTHER PUBLICATIONS

English translation of CN-220108530-U (Year: 2023).*
(Continued)

*Primary Examiner* — Jun S Yoo
(74) *Attorney, Agent, or Firm* — Barnes & Thornburg

(57) ABSTRACT

A method for manufacturing a distributor for refrigerant in components in a thermal management module is provided, distributor has distributor openings for the refrigerant on an upper surface and/or a lower surface that faces away from the upper surface. Greater reliability, reduced installation space, and greater variability in the shape of the distributor are obtained in that the distributor is produced in a casting process, in which channel sections of channels passing through the distributor are obtained with a removable core in a mold. A method for manufacturing a thermal management module that contains such a distributor, as well as a distributor produced in this manner, and a thermal management module is provided.

8 Claims, 5 Drawing Sheets

(51) Int. Cl.
*B22C 9/24* (2006.01)
*F25B 41/42* (2021.01)

(56) References Cited

FOREIGN PATENT DOCUMENTS

| | | | | |
|---|---|---|---|---|
| DE | 102010054496 | B4 | 6/2020 | |
| DE | 102021130297 | A1 | 5/2023 | |
| EP | 3199901 | A1 | 8/2017 | |
| LU | 502349 | B1 * | 1/2024 | ..... B22C 9/02 |

OTHER PUBLICATIONS

English translation of DE-102010002999-A1 (Year: 2011).*
English translation of LU-502349-B1 (Year: 2024).*
English translation of Search Report issued in DE102023205049.8 (Feb. 2, 2024).

* cited by examiner

METHOD FOR MANUFACTURING A DISTRIBUTOR FOR REFRIGERANT IN A THERMAL MANAGEMENT MODULE

CROSS-REFERENCE TO RELATED APPLICATIONS

This application claims priority from German Patent Application No. 102023205049.8, filed on May 30, 2023, the entirety of which is hereby fully incorporated by reference herein.

The invention relates to a method for manufacturing a distributor for refrigerant in a thermal management module. The invention also relates to a distributor manufactured in this manner. The invention further relates to a method for manufacturing a thermal management module, and a thermal management module manufactured in this manner. The invention also relates to a vehicle that contains such a thermal management module.

When a thermal management system is in operation, heat is transferred to a refrigerant in a cycle and discharged therefrom. This cycle normally comprises a variety of components for this, such as heat exchangers and valves.

It is conceivable to combine at least some of these components to obtain a module, also referred to below as a thermal management module. Distribution of the refrigerant in such a thermal management module can take place with a distributor. The refrigerant flows through the distributor, which contains opening through which the refrigerant is distributed to the components.

The object of the present invention is to create a method for manufacturing such a distributor, a method for manufacturing such a thermal management module, and to obtain improved or at least alternative embodiments of such a thermal management module for a vehicle.

These problems are solved by the subject matter of the independent claims. Advantageous embodiments are the subject matter of the dependent claims.

The present invention is based on the idea of manufacturing a distributor for refrigerant in a thermal management module in a casting process, through which at least one channel runs, a section of which through which the refrigerant flows is closed, which is produced in the casting process by a core that is subsequently removed. This eliminates the need to subsequently close off one end of this section with additional components, e.g. covers, which are needed in particular for distributors that are forged. The distributor consequently has fewer interfaces, resulting in less leakage and the capacity to accommodate higher pressures. This means that it is more reliable, and can be used with pressurized refrigerants, e.g. $CO_2$, or R744. The manufacturing method according to the invention also results in a more compact distributor, which can assume a greater variety of shapes. By way of example, the distributor can be angular and/or curved.

In accordance with this, the distributor is manufactured in a casting process. The distributor has an upper and a lower surface. It also contains at least one channel that forms a flow path for the refrigerant, at least a section of which is closed off at the upper or lower surface, which is also referred to as the channel section. The distributor has openings on the upper and/or lower surface through which the refrigerant is distributed to the components of the thermal management module, which are also referred to as distributor openings. The path for the refrigerant passes through the distributor openings. A mold is obtained for manufacturing the distributor. A core is placed in at least one, preferably all, of the channel sections that are to be created, which can be subsequently removed. The material forming the distributor is then placed in the mold, covering the at least one core on the upper or lower surface that will be formed. After the material has hardened, the at least one core is removed, such that the desired channel section is obtained there.

Any material that can be used in a casting process can theoretically be used.

Ideally, the material is a metal or a metal alloy, e.g. aluminum or an aluminum alloy.

The material is preferably poured into the mold. This means that the distributor is preferably manufactured using a reusable mold. This involves using gravity or low pressure to fill the metal mold with the molten material. This results in a fine grain structure with better mechanical properties and greater density that is less permeable to liquids and gasses. This further prevents or reduces leakage.

The hardened material and the at least one core form an intermediate product.

The intermediate product is substantially the distributor, which still contains the at least one core.

The mold preferably contains a segment for the respective distributor openings, e.g. a projection, with which the distributors openings are formed during the casting process.

The mold is made of numerous parts, e.g. two parts, which are assembled when the material is placed therein, and subsequently taken apart to remove the intermediate product.

The refrigerant path passes through the at least one channel and therefore through the at least one channel section. The distributor openings are therefore connected to the at least one channel section for fluid exchange.

At least one of the channel sections advantageously opens into at least one of the distributor openings. This means that at least one of the distributor openings is directly connected to at least one of the channel sections.

The distributor is used to distribute refrigerant in a thermal management module. The thermal management module contains components through which the refrigerant flows selectively when in operation. The refrigerant is therefore distributed to these components by the distributor. Distribution in this context refers to supplying and/or draining the refrigerant.

The refrigerant circulates through the thermal management module during which it undergoes a thermodynamic cycle. Consequently, the refrigerant can release and/or absorb heat in different operating modes of the thermal management module.

The components in the thermal management module preferably include at least one heat exchanger, in which the refrigerant exchanges heat with another fluid.

Other components of the thermal management module can include a compressor with which the refrigerant is pressurized and conveyed, and an expander with which the refrigerant is expanded, which may contain an expansion valve.

The thermal management module can advantageously be operated in at least one heat pump mode, in which heat from a colder fluid is pumped into the refrigerant in at least one of the at least one heat exchangers.

The thermal management module is used to control the temperature in a space and/or parts of an associated application. The thermal management module can be part of an air conditioning system, or it can form an air conditioning system.

The thermal management module is used in a vehicle, for example, to control the temperature of parts of the vehicle, e.g. traction components, in particular a traction battery, and/or the interior of the vehicle.

In addition to the distributor openings on the upper and/or lower surfaces, the distributor can also have at least one more distributor opening for a component of the thermal management module. In particular, the distributor can have at least one distributor opening on a lateral surface connecting the upper and lower surfaces.

The distributor openings on the lateral surface are preferably also produced in the casting process.

By way of example, the distributor openings on the upper and/or lower surfaces can be dedicated to heat exchangers and/or a compressor in the thermal management module, and at least one of the distributor openings on the lateral surface can be dedicated to an expansion valve in the thermal management module.

The at least one core can be of any type that can be removed after the material has hardened.

In preferred embodiments, at least one of the cores can be flushed out to remove it. This means that this at least one core is placed in the mold such that is can later be flushed out to remove it. It is then flushed out after the material has hardened, thus removing it. It is flushed out with a liquid, preferably water, to remove it. This substantially simplifies the process, and also allows the core to be placed anywhere in the mold, and therefore placing the respective channel section anywhere therein. This means that in addition to a simplified and less expensive production of the distributor, it is also possible to better vary the production of the distributor.

At least one of the cores, in particular the core that can be flushed out, is made of sand for example.

The at least one core, in particular the core that can be flushed out, is preferably made of salt. This means that at least one core made of salt is placed in the mold. This core is particularly heat-resistant, and can be easily removed, in particular by flushing it out. The high level of heat resistance results in a precise and defined placement of the associated channel section, and thus in a corresponding increase in the precision of the production of the distributor. The simplified removal of the salt core also results in a simplified and less expensive production of the distributor.

Variants in which at least one of the salt cores is sintered are regarded as advantageous. These sintered salt cores are more mechanically robust, and can be produced in any shape. Consequently, they will not become significantly deformed during the casting process, such that the associated channel section is more precise and defined, thus allowing for greater variability in the shape of the channel section. This results in a more precisely manufactured distributor, which can have a more complex shape. Consequently, it can be better adapted to the available space in which it is to be installed, in particular by reducing the necessary installation space.

At least one of the components to which the refrigerant is to be distributed by the distributor is advantageously attached to the distributor in the thermal management module. The distributor preferably has a flange for this component, which is also referred to below as a distributor flange. A least one component can be directly attached to the distributor with this flange. This results in a simplified production of the thermal management module.

The at least one distributor flange preferably contains a distributor opening. This results in a compact design for the thermal management module, which can be more easily manufactured.

In preferred embodiments, the at least one distributor flange is produced in the casting process. The mold can be shaped accordingly, in particular by containing a corresponding shape therein for the flange. This further simplifies manufacturing of the distributor.

In producing the thermal management module, the components supplied by the distributor with refrigerant are connected to at least one of the distributor openings for fluid exchange, such that the path for the refrigerant passes through the respective component, and the distributor can supply refrigerant thereto when in operation.

The at least one component supplied with refrigerant by the distributor is preferably attached to the distributor, specifically mechanically.

In preferred embodiments, this is obtained with distributor flanges. This means that at least one of the components supplied with refrigerant by the distributor is attached to the distributor with a flange.

To attach the components to the distributor with a flange, the components preferably have corresponding flanges, which are referred to below as component flanges. The component flange is then attached to a distributor flange.

In a preferred embodiment, the distributor has at least one mount. The at least one mount is used to attach a component to the distributor, mount the thermal management module in a vehicle, or to attach components that do not conduct refrigerant, e.g. cables, connectors, etc. This mount is also preferably obtained in the casting process.

The at least one mount can have an arbitrary design. By way of example, the mount can contain a screw hole.

The distributor preferably has a hole that passes through the upper and lower surfaces. The hole can be in the middle of the distributor, for example. This reduces the weight of the distributor.

The hole is preferably formed in the casting process. This reduces material consumption.

In advantageous embodiments, the distributor has at least one recess that is open at the lower surface and closed at the upper surface, and/or at least one recess that is open at the upper surface and closed at the lower surface. This also reduces the weight of the distributor.

The at least one recess is preferably produced in the casting process. This reduces material consumption.

It is understood that a distributor manufactured in this manner and a thermal management module produced in this manner also belong to the scope of this invention.

It is also understood that a vehicle containing this thermal management module also belongs to the scope of this invention.

Other important features and advantages of the invention can be derived from the dependent claims, the drawings, and the descriptions of the drawings.

It is understood that the features explained herein can be used not only in the combinations described here, but also in other combinations or in and of themselves, without abandoning the scope of the present invention.

Preferred exemplary embodiments of the invention are shown in the drawings, and shall be explained in greater detail below, in which the same reference symbols refer to the same or functionally similar components.

Therein, schematically:

Figure 1:
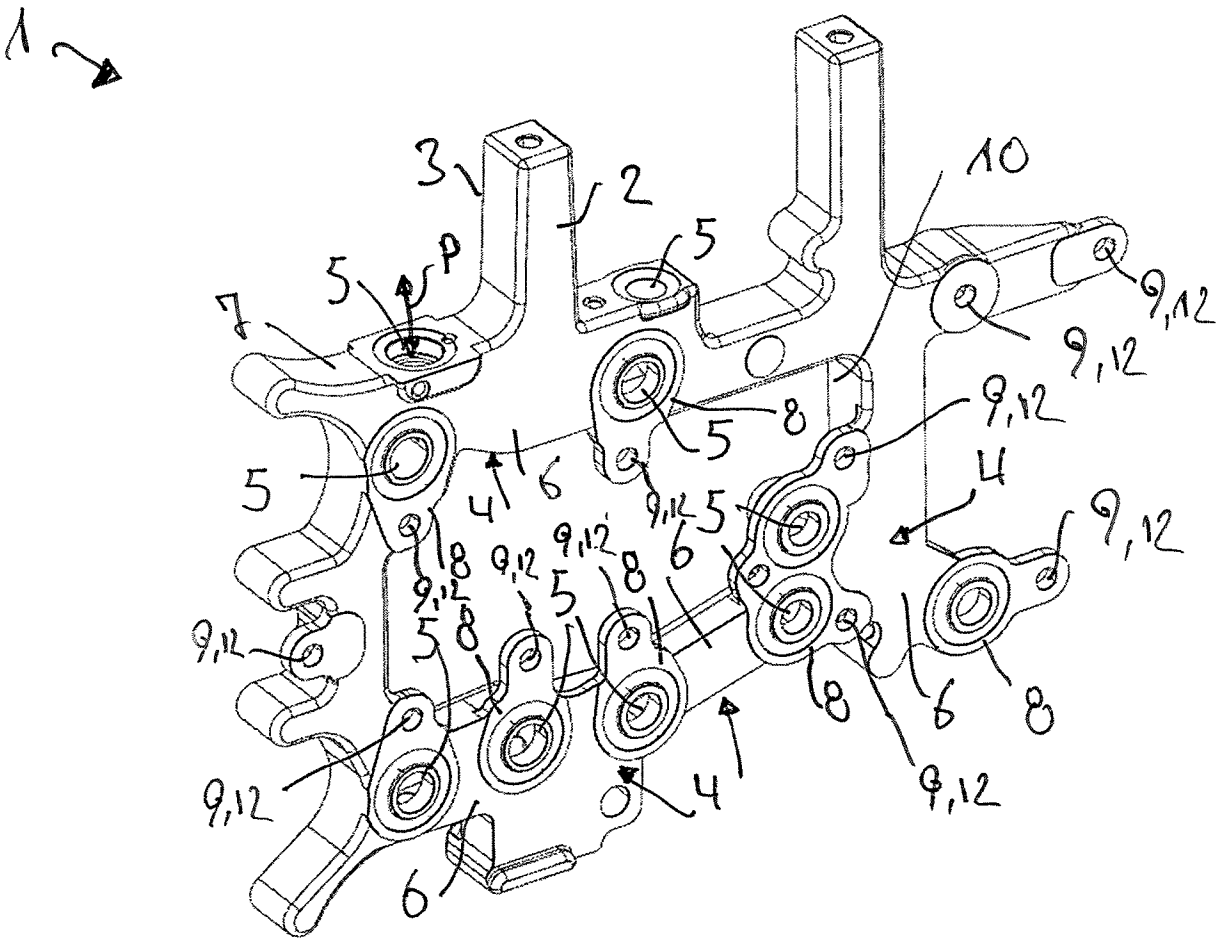
FIG. 1 shows an isometric view of a distributor.
Figure 2:
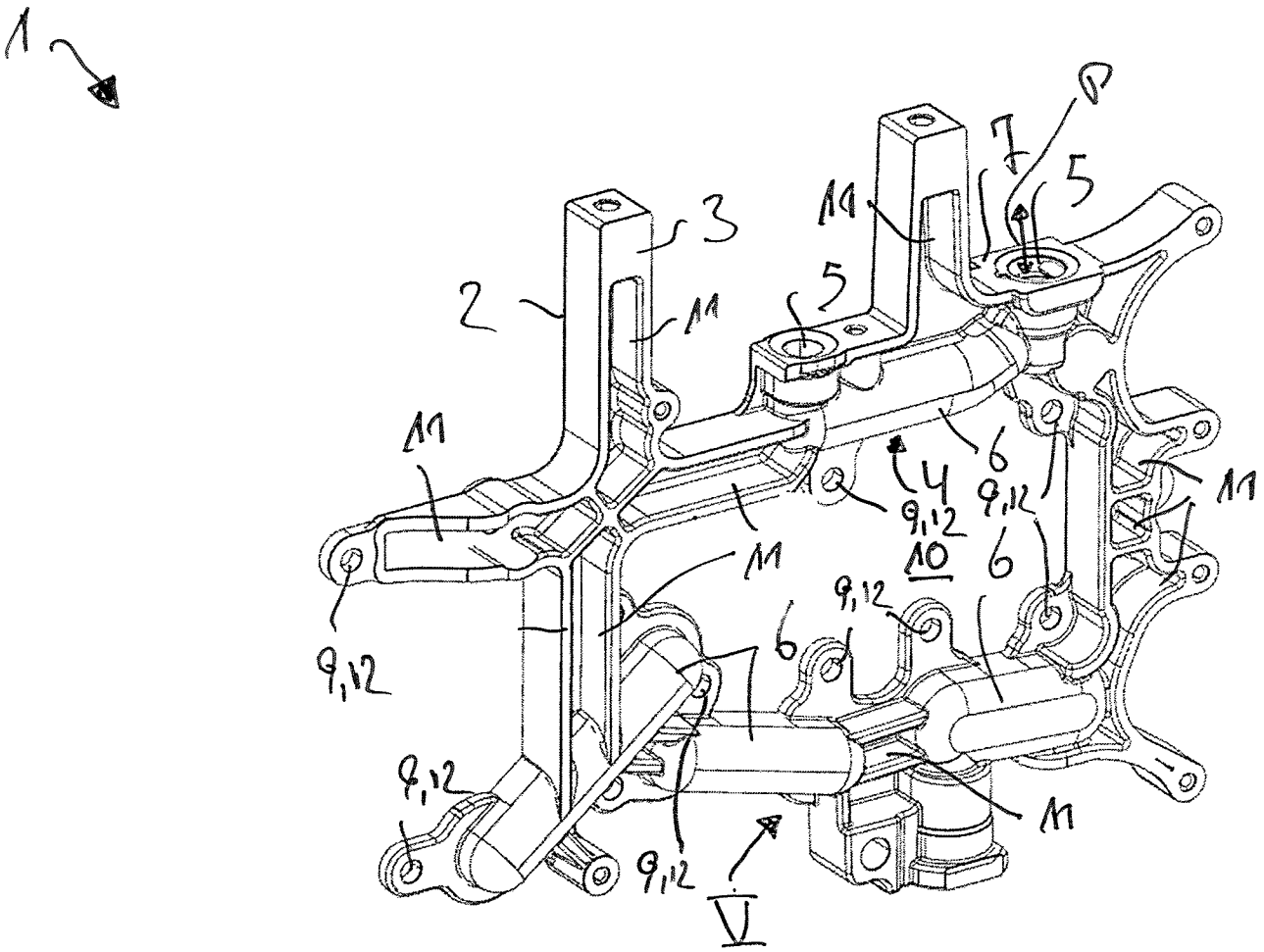
FIG. 2 shows another isometric view of the distributor.
Figure 3:
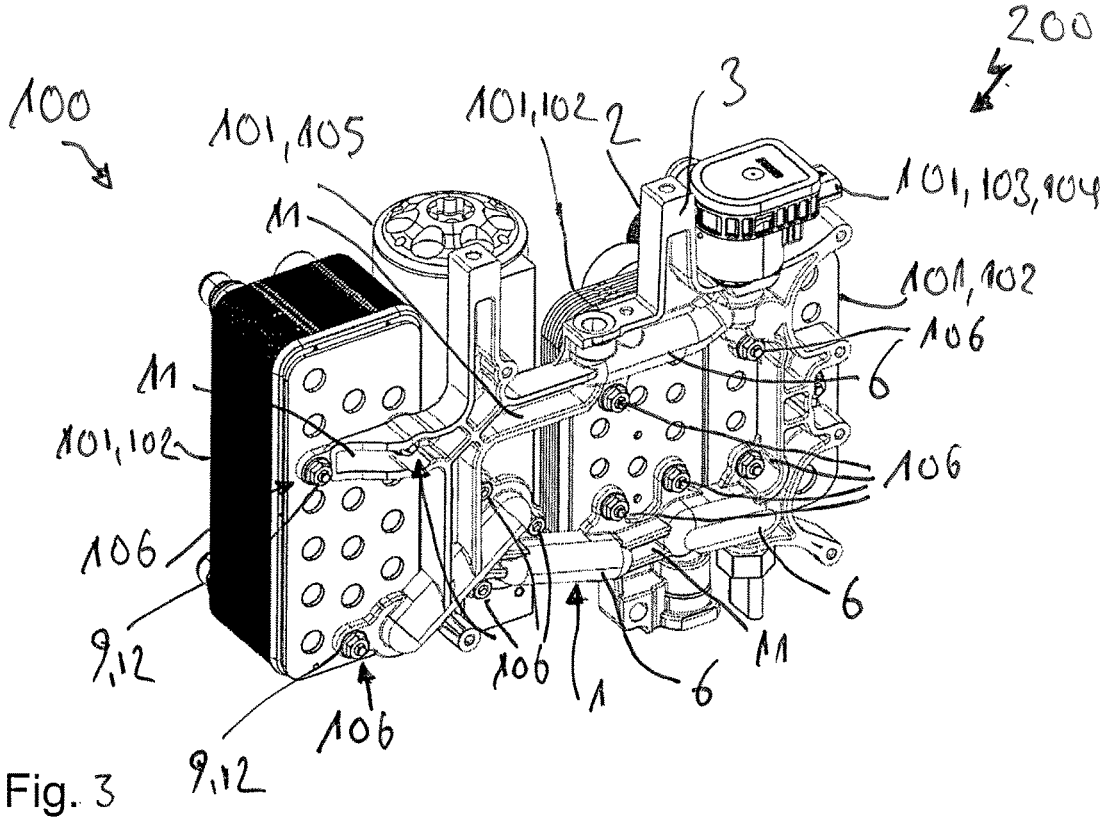
FIG. 3 shows an isometric view of a thermal management module containing the distributor.

The distributor 1 illustrated in FIGS. 1 to 3, 6 and 7, is used to distribute refrigerant in a thermal management module 100 such as that shown in FIG. 3. The refrigerant circulates through the thermal management module 100 and undergoes a cycle in which heat is transferred from the refrigerant to other fluids, and/or heat is transferred from other fluids to the refrigerant. The thermal management module 100 contains components 101 in addition to the distributor 1 through which the refrigerant can flow. A flow path P for the refrigerant, only indicated in FIGS. 1 and 2, therefore passes through the components 101. Heat exchanger 102 are some of these components 101 in this exemplary embodiment. The thermal management module 100 in the exemplary embodiment shown in FIG. 2 contains three heat exchangers 102, purely by way of example, which can function as condensers, chillers, or interior heat exchangers. As can be derived from FIG. 2, the thermal management module 100 also contains an expander 103 in the form of an expansion valve in this exemplary embodiment, with which the refrigerant is expanded. Another one of the components 101 in the thermal management module 100 in this exemplary embodiment is a reservoir 105.

The flow path P for the refrigerant passes through the distributor 1, which delimits the path P. The distributor 1 has an upper surface 2 and a lower surface 3. The distributor 1 has at least one channel 4 for the refrigerant, which passes through the distributor 1. At least one channel 4 therefore forms the path P for the refrigerant. The distributor 1 contains openings 5 for distributing the refrigerant to the components 101, which are also referred to as distributor openings 5. This means that the distributor openings 5 for the refrigerant are each connected to an associated component 101 in the thermal management module 100. Sections 6 of the at least one channel 4 that are closed at the upper surface 2 and lower surface 3 lead to the distributor openings 5, which are also referred to as channel sections 6. As can be derived from viewing FIGS. 1 and 2 together, the distributor 1 has these distributor openings 5 on the upper surface 2 and/or the lower surface 3. In the exemplary embodiments shown therein, the distributor 1 has distributor openings on the upper surface 2, but not on the lower surface 3, merely by way of example. It can also be derived from viewing FIGS. 1 to 3 collectively that the heat exchanger 102 and reservoir 105 in this exemplary embodiment are connected to the distributor openings 5 on the upper surface 2 for fluid exchange. As can be derived from viewing FIGS. 1 and 2 collectively, the distributor in this exemplary embodiment also has at least one distributor opening 5 on a lateral surface 7 of the distributor connecting the upper surface 2 to the lower surface 3. One of these distributor openings 5 is dedicated to the expander 103 in this exemplary embodiment. At least one of the distributor openings 5 can be dedicated to a compressor in the thermal management module 100, not shown for purposes of clarity, which pressurizes the refrigerant as a means of conveyance.

As can be derived from FIG. 3, at least the visible components 101 in the thermal management module 100 in this exemplary embodiment are not connected to the distributor 1 for fluid exchange, but instead are attached to the distributor 1. These components 101 are attached to the distributor 1 with a flange. The distributor 1 has flanges 8 that can be seen in FIG. 1 for this, which are also referred to as distributor flanges 8. The distributor flanges 8 each have at least one distributor opening 5. The components advantageously have corresponding flanges, which are not shown.

Figure 4:
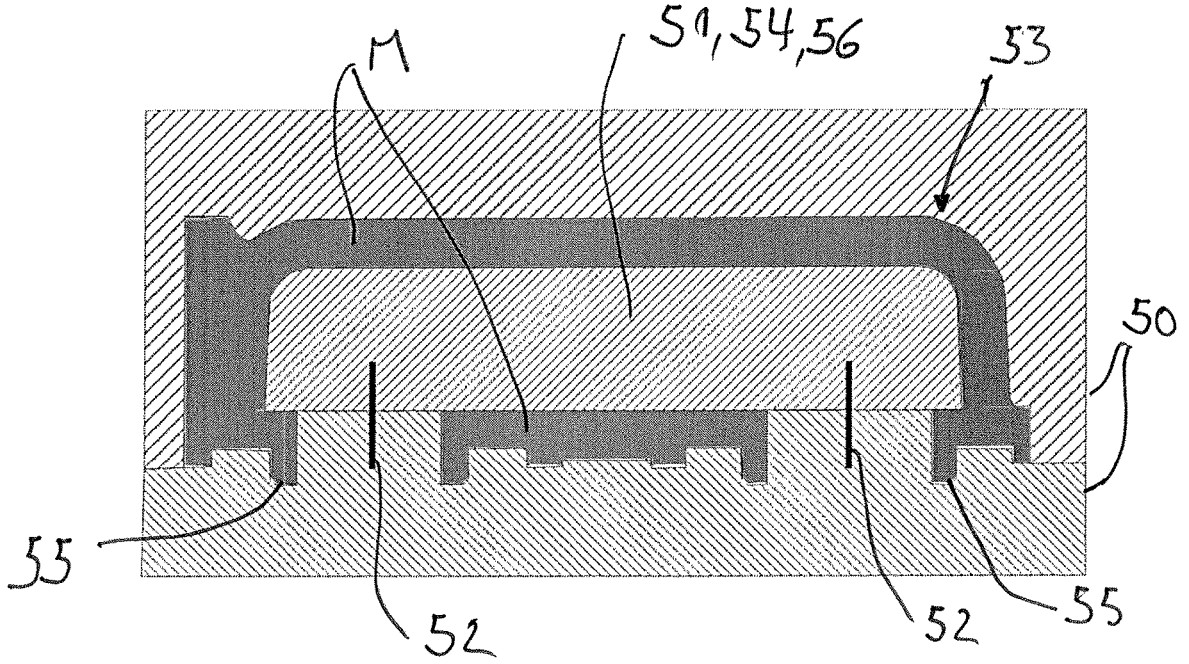
FIG. 4 shows a sectional view cut through a mold during the production of the distributor with a core.

As explained below, the distributor 1 is produced in a casting process. The mold 50 shown in FIG. 4 is used for this, into which the material M from which the distributor 1 is to be formed, e.g. aluminum or an aluminum alloy, is preferably poured.

Figure 5:
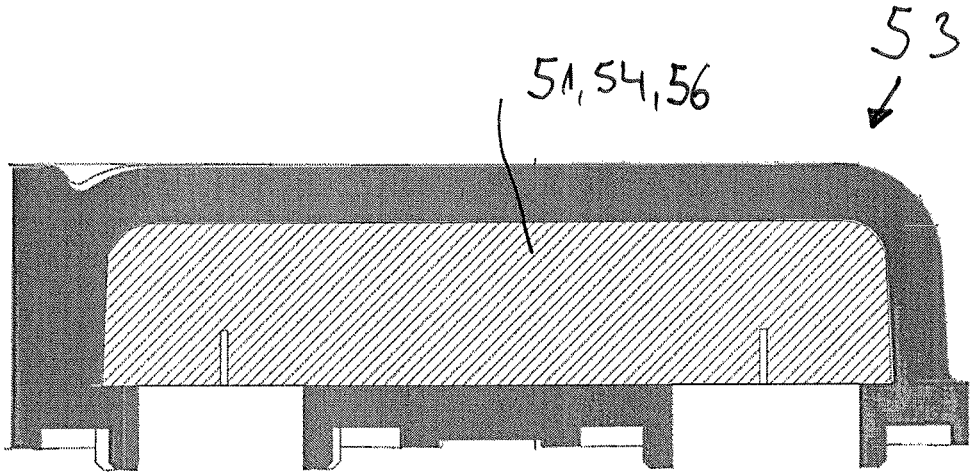
FIG. 5 shows a sectional view cut through an intermediate product, with the core for producing the distributor.
Figure 6:
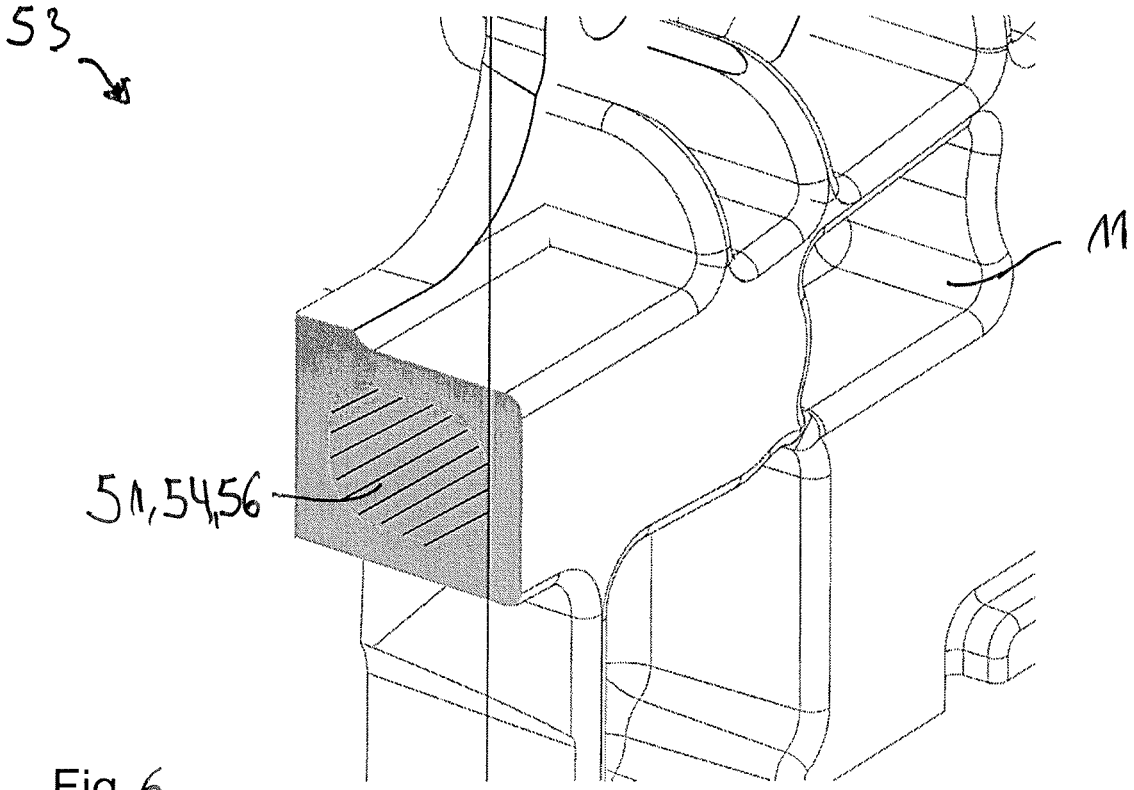
FIG. 6 shows an isometric sectional view of the intermediate product with a core in the core region.
Figure 7:
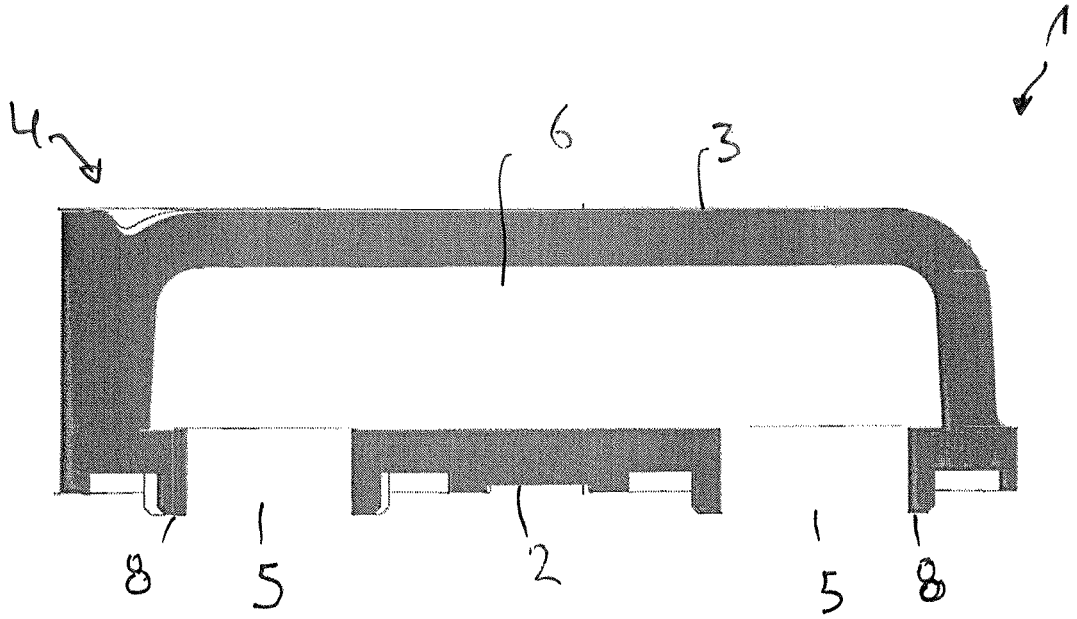
FIG. 7 shows the same illustration in FIG. 5, after the core has been removed.
Figure 8:
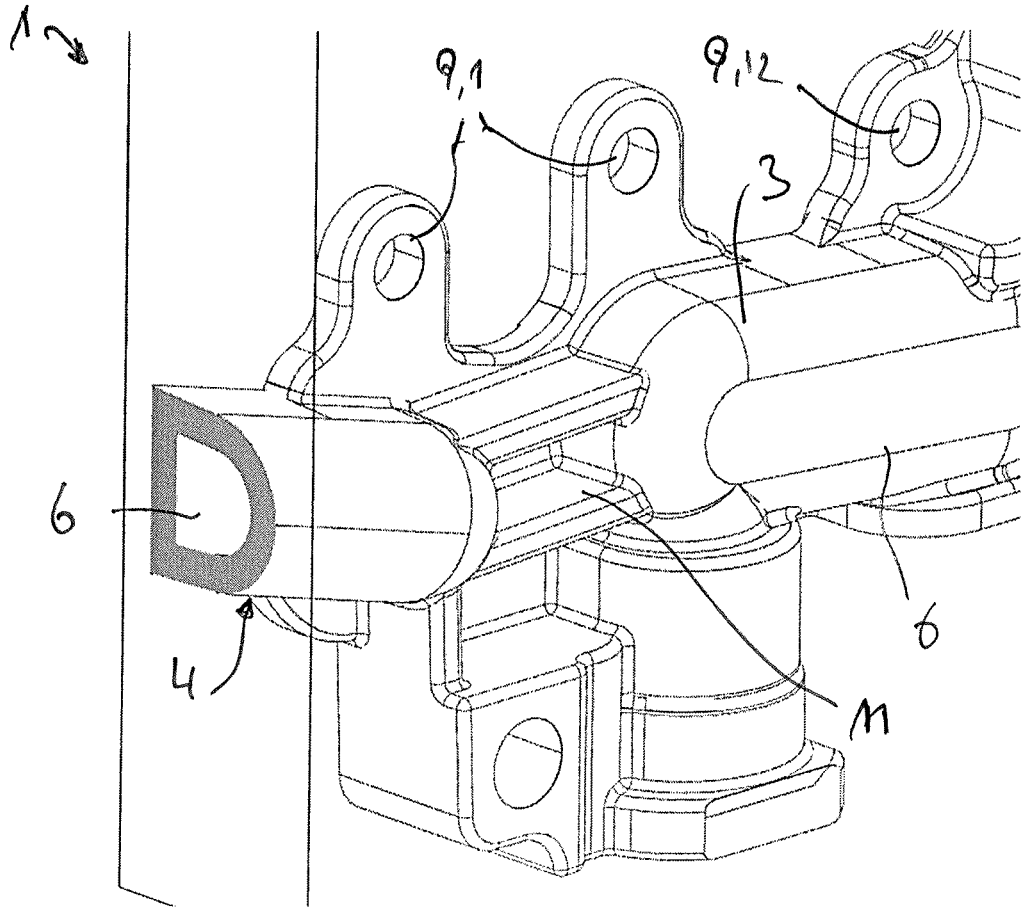
FIG. 8 shows another isometric sectional view of the region shown in FIG. 6, after the core has been removed.

The distributor 1 is preferably produced in a casting process using reusable molds. The mold 50 is made of at least two parts, such that it can be opened and closed, as shown in FIG. 4, in which the mold 50 is shown in the closed state. A section of the mold 50 is shown in FIG. 4, in which one of the canal sections 6 will be formed later. As can be seen in FIG. 4, a removable core 51 is placed where one of the channel sections 6 is to be formed in the distributor 1. As can also be seen in FIG. 4, the core 51 is secured in place in the mold 50 with at least one pin 52. The material M is then poured into the mold 50, such that the material M covers the at least one core 51 on what will become the upper surface 2 and lower surface 3. FIG. 4 shows the state when the material M has already been placed in the mold 50. After the material has hardened, an intermediate product 53 is obtained that is then removed from the mold 50. FIGS. 5 and 6 show the intermediate product 53, showing the section from FIG. 4 in FIG. 5, and an isometric illustration in FIG. 6 that corresponds to the part of the distributor 1 indicated by a V in FIG. 2. As can be derived from viewing FIGS. 5 and 7 with 6 and 8, the at least one core 51 is subsequently removed from the intermediate product 53, leaving the channel section 6 in its place. FIG. 7 shows FIG. 5 after the core 51 has been removed, and FIG. 8 shows the visible part in FIG. 6 in another isometric illustration after removal of the core 51.

This results in a lower number of interfaces on the distributor 1 and between the distributor 1 and the components 101. This reduces the probability of refrigerant leakages. The distributor 1 can consequently also withstand higher internal pressures. The thermal management module 100 can therefore be operated at higher refrigerant pressures. Consequently, $CO_2$, or R744 can be used as the refrigerant.

In these exemplary embodiments, the distributor 1 has a hole 10 through the middle, as can be seen in particular in FIGS. 1 and 2. These exemplary embodiments of the distributor 1 also have recesses 11 that open at the lower surface 3 and are closed at the upper surface 2, as can be seen in FIG. 2. The hole 10 and recesses 11 are produced in the molding process, and reduce the weight of the distributor 1 and the amount of material M that is used.

The core 51 in these exemplary embodiments is a, preferably sintered, salt core 54, which is flushed out of the intermediate product 53, ideally with water.

As can be seen by viewing FIGS. 4, 5 and 7 together, the distributor flange 8 is also produced by the molding process in these exemplary embodiments. The mold 50 contains a shape 55 for the distributor flange 8, indicated in FIG. 4.

To produce, or assemble, the thermal management module 100, the components 101 are connected to at least one of the distributor openings 5 for fluid exchange, such that the path P for the refrigerant passes through the respective components 101 and the distributor 1 can distribute refrigerant to the components 101. These components 101 are attached to the flanges on the distributor 1 in the manner described above. The distributor 1 has at least one mount 9 in these exemplary embodiments, as shown in FIGS. 1 and 2, for example. It can also be seen in FIG. 3 that at least some of the components 101 can be attached to the distributor 1 with screws 106. The mounts 9 have screw holes 12 in these exemplary embodiments. These mounts 9 are also produced in the casting process. At least some of the mounts 9 can also be used to attach the thermal management module 100 to the vehicle 200 and/or for components such as cables and connectors (not shown), through which no refrigerant flows.

The thermal management module 100 can be used, for example, in a vehicle 200, in particular powered by a battery, which is not shown otherwise. The thermal management module 100 controls the temperature in an interior and/or drive components such as a traction battery, which are not shown in the drawings.

The specification is readily understood with reference to the following Numbered Paragraphs:

Numbered Paragraph 1. A method for manufacturing a distributor (1) for distributing refrigerant in a thermal management module (100), in particular for a vehicle (200), wherein the distributor (1) contains:

an upper surface (2) and a lower surface (3) facing away from the upper surface (2), at least one channel (4) that forms a flow path (P) for the refrigerant and is closed in at least one section (6) at the upper surface (2) and the lower surface (3), distributor openings (5) on the upper surface (2) and/or the lower surface (3) for distributing refrigerant to the components (101) in the thermal management module (100), through which the flow path (P) passes, wherein the distributor (1) is produced in a casting process, wherein a removable core (51) is placed in the mold (50) where a channel section (6) is to be formed, wherein the material (M) forming the distributor (1) is placed in the mold (50) such that the material (M) covers the at least one core (51) where the upper surface (2) and lower surface (3) are formed, wherein the at least one core (51) is removed after the material (M) hardens, such that the channel section (6) is formed in its place.

Numbered Paragraph 2. The method according to Numbered Paragraph 1, characterized in that the at least one core (51) that is placed in the mold (50) can be flushed out to remove it, the core (51) is flushed out and thus removed after the material (M) hardens.

Numbered Paragraph 3. The method according to Numbered Paragraph 1 or 2, characterized in that the at least one core (51) that is placed in the mold (50) is a salt core (54) or sand core (56).

Numbered Paragraph 4. The method according to Numbered Paragraph 3, characterized in that the core (51) that is placed in the mold (50) is a sintered salt core (54).

Numbered Paragraph 5. The method according to any of the Numbered Paragraphs 1 to 4, characterized in that the distributor (1) is produced with at least one distributor flange (8) with which components (101) in the thermal management module (100) can be attached to it, which contains a distributor opening (5).

Numbered Paragraph 6. The method according to Numbered Paragraph 5, characterized in that at least one of the distributor flanges (8) is produced in the casting process.

Numbered Paragraph 7. The method according to any of the Numbered Paragraphs 1 to 6, characterized in that the distributor (1) has at least one mount (9), in particular with a screw hole (12), for attaching to at least one of the components (101), and/or the thermal management module (100), produced in the casting process.

Numbered Paragraph 8. A distributor (1) for refrigerant in a thermal management module (100), wherein the distributor (1) is produced with the method according to any of the Numbered Paragraphs 1 to 7.

Numbered Paragraph 9. A method for producing a thermal management module (100), through which refrigerant circulates, in particular for a vehicle (200), wherein at least two of the components (101) in the thermal management module (100) are heat exchangers (102), and wherein at least two of the components (102) are supplied with refrigerant by a distributor (1) in the thermal management module (100), wherein the distributor (1) is produced with the method according to any of the Numbered Paragraphs 1 to 7, and wherein the components (101) supplied with refrigerant by the distributor (1) are connected to at least one of the distributor openings (5) for fluid exchange, such that the flow path (P) for the refrigerant passes through these components (101), and the distributor distributes refrigerant to the components (101) when in operation.

Numbered Paragraph 10. The method according to Numbered Paragraph 9, characterized in that at least one of the components (101) supplied by the distributor (1) is attached to the distributor, in particular with a flange.

Numbered Paragraph 11. A thermal management module (100), in particular for a vehicle (200), wherein the thermal management module (100) is produced with the method according to Numbered Paragraph 9 or 10.

Numbered Paragraph 12. A vehicle (200) that contains a thermal management module (100) according to Numbered Paragraph 11.

The invention claimed is:

1. A method for manufacturing a distributor for distributing refrigerant in a thermal management module for a vehicle, wherein the distributor comprises:

an upper surface and a lower surface facing away from the upper surface, at least one channel that forms a flow path for the refrigerant and is closed in at least one section at the upper surface and the lower surface, distributor openings on the upper surface and/or the lower surface for distributing the refrigerant to components in the thermal management module, through which the flow path passes, placing at least one removable core in a mold where the at least one channel is to be formed, placing a material in the mold thereby forming the distributor, such that the material covers the at least one core where the upper surface and the lower surface are formed, removing the at least one core after the material hardens, such that the at least one channel is formed in its place, and producing at least one distributor flange within the distributor with which the components in the thermal management module are configured to be attached to the at least one distributor flange, wherein the at least one distributor flange contains at least one of the distributor openings only on the upper surface.

2. The method according to claim 1, wherein the step of placing the at least one removable core is performed such that the mold is configured to be capable of being flushed out to remove the core, wherein the removing the at least one core comprises flushing out the core after the material hardens.

3. The method according to claim 1, wherein the at least one core that is placed in the mold is a salt core or sand core.

4. The method according to claim 3, wherein the core that is placed in the mold is a sintered salt core.

5. The method according to claim 1, further comprising the step of producing at least one of the at least one distributor flanges in a casting process.

6. The method according to claim 1, wherein the distributor has a screw hole, the screw hole being configured for attaching to at least one of the components, and/or the thermal management module, further comprising casting the distributor.

7. A method for producing a thermal management module, through which refrigerant circulates, the thermal management module being for a vehicle, wherein at least two components in the thermal management module are heat exchangers, and wherein the at least two of the components are supplied with refrigerant by a distributor in the thermal management module, producing the distributor with the method according to claim 1, and connecting the components supplied with the refrigerant by the distributor to at least one of the distributor openings for fluid exchange, such that the flow path for the refrigerant passes through these components, and wherein the distributor is configured to distribute the refrigerant to the components when in operation.

8. The method according to claim 7, characterized in that at least one of the components supplied by the distributor is attached to the at least one distribution flange.

* * * * *